US005996472A

United States Patent [19]

Nguyen et al.

[11] Patent Number: 5,996,472

[45] Date of Patent: Dec. 7, 1999

[54] CRYOGENIC RECIPROCATING PUMP

[75] Inventors: Dan Dinh Nguyen; Donald Craig Tooms, both of Houston, Tex.

[73] Assignee: Chemical Seal and Packing, Inc., Houston, Tex.

[21] Appl. No.: 08/726,649

[22] Filed: Oct. 7, 1996

[51] Int. Cl.[6] ..... F16J 9/00

[52] U.S. Cl. ..... 92/245; 92/240; 92/172; 417/901; 277/439; 277/530

[58] Field of Search ..... 92/172, 240, 241, 92/245; 417/901; 277/438, 439, 530

[56] References Cited

U.S. PATENT DOCUMENTS

| | | | |
|---|---|---|---|
| 2,730,957 | 1/1956 | Riede . | |
| 2,837,898 | 6/1958 | Ahlstrand . | |
| 3,016,717 | 1/1962 | Gottzmann . | |
| 3,263,622 | 8/1966 | Tyree . | |
| 3,653,670 | 4/1972 | Sifri et al. | 277/439 |
| 4,239,460 | 12/1980 | Gölz . | |
| 4,244,192 | 1/1981 | Chellis | 277/439 |
| 4,396,362 | 8/1983 | Thompson, et al. . | |
| 4,576,557 | 3/1986 | Pevzner . | |
| 4,639,197 | 1/1987 | Tornare, et al. . | |
| 4,706,970 | 11/1987 | Ramirez | 277/439 |
| 4,792,289 | 12/1988 | Nieratschker . | |
| 5,133,419 | 7/1992 | Barrington | 464/26 |
| 5,511,955 | 4/1996 | Brown, et al. . | |
| 5,542,682 | 8/1996 | Goldstein et al. | 277/164 |
| 5,671,656 | 9/1997 | Cyphers et al. | 92/172 |

FOREIGN PATENT DOCUMENTS

| | | |
|---|---|---|
| 843716 | 6/1970 | Canada . |
| 60-75776 | 4/1985 | Japan . |

*Primary Examiner*—Thomas E. Denion

*Attorney, Agent, or Firm*—Gardere & Wynne, L.L.P.; John W. Montgomery

[57] ABSTRACT

A novel reciprocating pump for cryogenic fluids. The pump has a cylinder sleeve, head, intake valve, discharge valve, and a reciprocating piston including a mechanical spring energized seal having a generally U-shaped jacket and a helical spring in the bight of the U.

9 Claims, 2 Drawing Sheets

CRYOGENIC RECIPROCATING PUMP

TECHNICAL FIELD

This invention relates generally to cryogenic reciprocating pumps and in particular to low-flow, high pressure cryogenic reciprocating pumps operating in liquified natural gas service in transportation vehicles.

BACKGROUND OF THE INVENTION

Liquified natural gas (LNG) has been proposed as a fuel in transportation vehicles such as automobiles and buses. However, use of LNG in transportation vehicles presents a number of problems that have not previously been satisfactorily solved.

LNG is a cryogenic liquid stored under saturated conditions. Therefore, all materials in contact with it must be able to perform satisfactorily at cryogenic temperatures in the range of approximately 90 to 190 degrees Kelvin, depending upon the storage pressure. This includes the pump for transferring the LNG from the storage reservoir to the engine.

Although LNG pumps are well-known, such pumps are usually used in process plants where the pumps are under relatively continuous monitoring. By contrast, LNG pumps in transportation service must be able to perform reliably for long periods of time (up to several years) under start-stop conditions without continuous monitoring and without excessive maintenance. This is difficult since LNG pumps operate without lubrication other than the LNG, which has relatively low lubricity. Such pumps must also be able to operate at high discharge pressure but low flow rates, which increases the difficulty of maintaining low rates of leakage past the check valves and piston rings.

In addition, because LNG is a saturated liquid, pumps must have very low suction pressure requirements to prevent cavitation. These requirements are difficult to meet in any reciprocating pump and, in transportation vehicles, the available suction pressure may be particularly low due to the limitations of size and placement of the LNG storage reservoir.

Although some efforts have been made to meet some of the requirements of LNG pumps on transportation vehicles, such efforts have not satisfactorily solved all the problems in a cost-effective manner. For example, in one cryogenic pump, a ceramic coating on the inside surface of the cylinder sleeve has been proposed to minimize wear on the cylinder sleeve during use in an effort to meet the reliability requirements. However, ceramic coatings are relatively expensive. Furthermore, ceramic coatings can flake off, presenting problems.

Accordingly, there is a need for an LNG reciprocating pump that can meet high standards for reliability and performance, particularly under low suction pressure, high discharge pressure, low flow rate conditions, and can meet these standards in a cost effective manner.

SUMMARY OF THE INVENTION

The present invention comprises a reciprocating pump for cryogenic fluids having a cylinder sleeve, head, intake valve, discharge valve, and reciprocating piston, the piston including a mechanical spring energized seal having a generally U-shaped jacket and a helical spring in the bight of the U.

In a preferred aspect of this invention, the jacket is made of KEL-F brand polychlorotrifluoroethylene material and has a slight interference fit between the outer circumference of the piston and the inner wall of said cylinder.

In another preferred aspect of this invention, the U-shaped jacket includes legs having a convex outer wall in contact with said sleeve.

In another preferred aspect of this invention, the piston further includes at least one bronze filled PTFE piston ring.

In another preferred aspect of this invention, the sleeve is made from 440C stainless steel.

In another preferred aspect of this invention, the sleeve has a hardness of approximately Rockwell 55.

In still another aspect of this invention, said sleeve further has a surface finish of approximately number 8.

BRIEF DESCRIPTION OF THE DRAWINGS

For a more complete understanding of the present invention and the advantages thereof, reference is now made to the following DETAILED DESCRIPTION taken in conjunction with the accompanying drawings in which.

DETAILED DESCRIPTION

Figure 1:
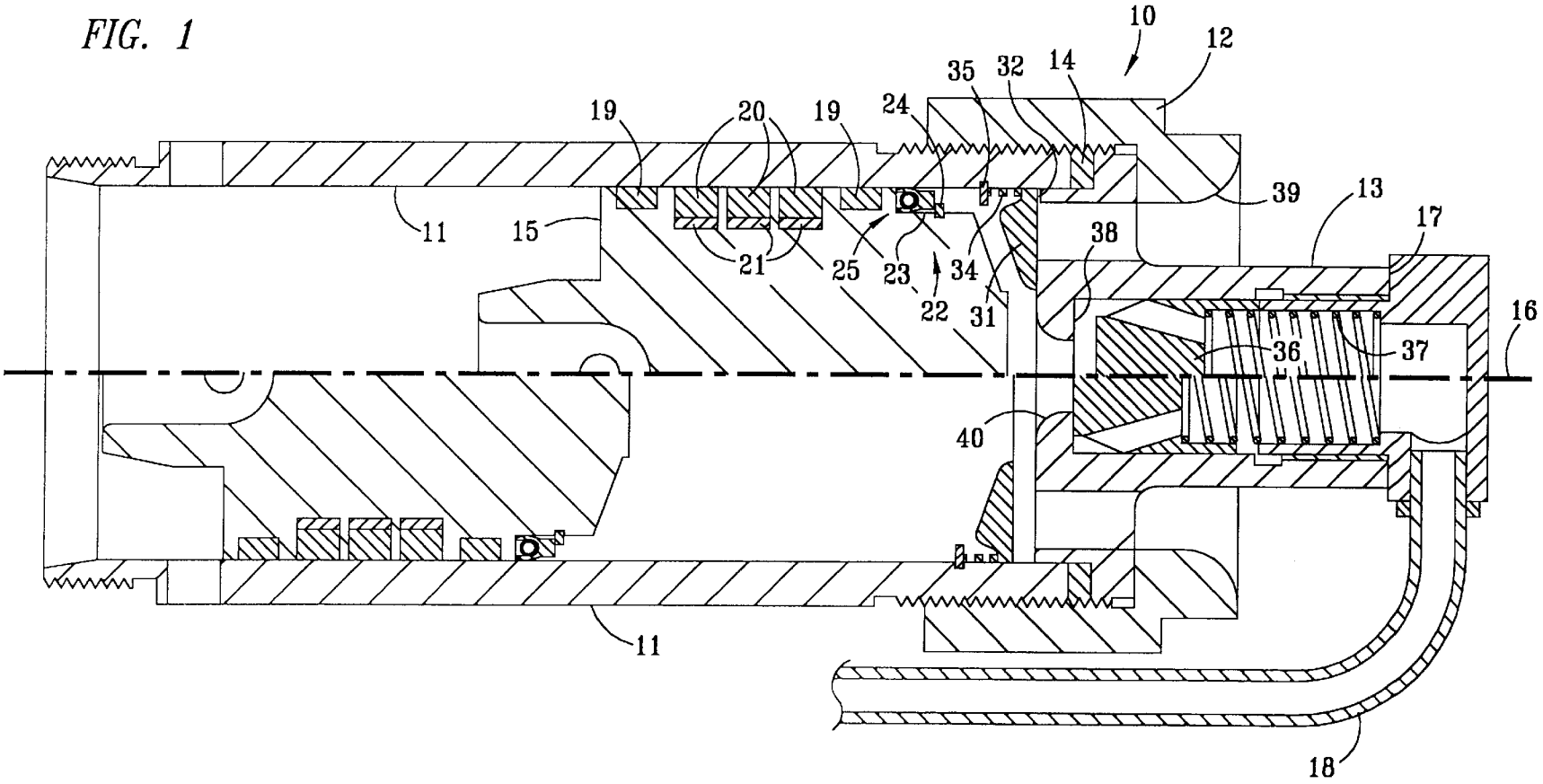
FIG. 1 is a split view of a cross section of the cylinder and inlet and outlets portions of the cryogenic pump of the present invention, the portion of the view above the cylinder centerline depicting the pump with the piston near top dead center, the discharge check valve open and the inlet check valve closed; the portion of the view below the cylinder centerline depicting the pump with the piston near bottom dead center, the discharge check valve closed and the inlet check valve open.

Referring now to the drawings in detail, wherein like reference characters designate like or similar parts in the figures, a cryogenic pump 10 in accordance with the present invention is depicted. Pump 10 is a reciprocating pump with a cylinder or sleeve 11, a head nut 12, threadably attached to sleeve 11 to retain cylinder head 13, sealed by gasket 14. A fitting 16 is threadably connected to the end of head 13, sealed by gasket 17, and receives discharge tube 18.

The pump 10 also has a piston 15 slidably reciprocal in sleeve 11. Of course, the reciprocating pump 10 of the present invention can be made in a variety of sizes to suit particular requirements, but for low flow, high pressure applications, a stroke of approximately 1.8 inches and a cylinder internal diameter of approximately 1.75 inches has been found to be suitable.

Piston 15 includes piston rider rings 19 and piston rings 20 which are both preferably made out of 60% bronze filled PTFE. Rider rings 19 are slotted longitudinally so they do not resist pressure and are present to position piston 15 and to minimize wear.

Piston rings 20 preferably include an expander ring 21, preferably made from 17-4 PH stainless, under the PTFE/bronze piston rings to press the piston rings 20 against sleeve 11 and thereby assist in sealing.

Piston 15 also includes a mechanical spring energized seal (MSE) 22 at its upper end, supported by a circumferential ledge 23 at the upper end of piston 15. MSE 22 is retained in place at the upper end of piston 15 by a retaining clip 24.

Figure 2:
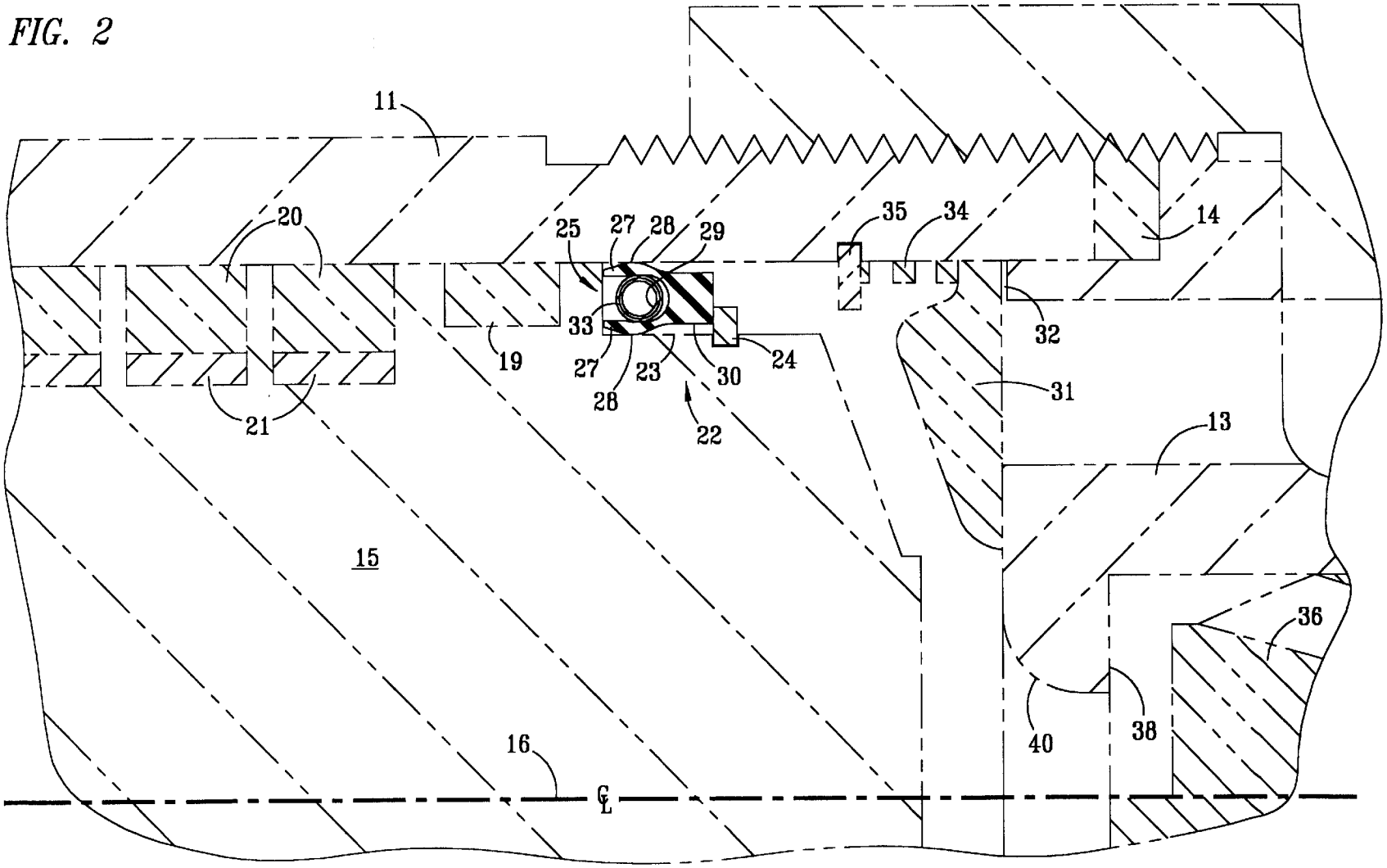
FIG. 2 depicts an enlarged cross section of the mechanical spring energized (MSE) seal or piston ring in accordance with the present invention.

Referring now to FIG. 2, MSE seal is depicted in cross-section. MSE seal 22 is comprised of a U-shaped jacket 30 preferably made out of KEL-F brand polychlorotrifluoroethylene, available from 3-M Company, Minnesota, or other chlorotrifluoroethylene having similar properties of strength and dimensional stability, and a double spring 25 preferably made out of Elgiloy stainless, a cobalt-nickel alloy having a yield strength of approximately 280 KSI (as used herein KSI shall mean "1,000 pounds per square inch") available from Elgiloy Company, Elgin, Ind. or other suitable material having similar mechanical properties. As depicted in FIG. 1, the back end 26 of the "U" of the jacket is generally rectangular and rests against the circumferential ledge 23 of piston 15, retained by retaining clip 24.

As depicted in FIG. 2, the legs 27 of the "U" are slightly concave on their inner walls, to help retain the double spring 25 in place in between the two legs. The legs 27 are also slightly convex on their outer walls 28 to fit against the outer circumference of piston 15 and to ride against the inner surface of sleeve 11. The slightly convex outer wall of the leg 27 which is in contact with the inner surface of sleeve 11 helps to provide superior sealing, without excessive wear.

For the size of the exemplary pump described herein, the jacket 30, including the legs 27, preferrably has a length in the axial direction of approximately 0.205inches, a width at the rectangular back end 26 of approximately 0.114 inches and a width at the convex outer walls of approximately 0.136 inches.

The double spring 25 is comprised of an inner and an outer concentric, closely wound helical springs 29 and 33, respectively, preferably made from rectangular Elgiloy wire, or other suitable material, approximately 0.035inches wide and 0.005 inches thick, wound so that the 0.005inches dimension is radial direction of the spring. The ends of the respective wires are spot welded together to complete the spring.

Double spring 25, as wound, preferrably has a length of approximately 5 and ⅛ inch for the size of the exemplary pump described herein. When in place on the piston 15, and installed in sleeve 11, the legs 27 of jacket 30 have a slight interference fit between the piston and the sleeve. This tends to push the legs 27 of the jacket together, squeezing the double spring 25. The double spring, in turn, exerts an outward force, which assists in the superior sealing of the MSE seal 22.

Piston 15 is preferably made out of 17-4 PH stainless, or other suitable material, to give high strength and rigidity. This helps to support the MSE seal 22 and TFE/bronze (wherein TFE stands for tetafluoroethylene) piston rings 20 against the high discharge pressure. This leads to less deflection and deformation due to the strain of discharge pressure as well as from the enormous change in temperature from assembling the pump in room temperature as compared to the cryogenic working temperature.

Sleeve 11 is preferrably made out of 440C stainless, or other suitable material having similar mechanical properties, and is preferrably heat treated to a hardness of preferably in the range of approximately Rockwell 50–55. Preferrably, the hardness is approximately Rockwell 55. The inside surface of sleeve 11 is finished to a range of approximately number 4 to number 8 surface finish, preferrably number 8, which is very smooth. The combination of the hard surface and smooth finish tends to minimize wear and tear due to the MSE seal 22 and TFE/bronze piston rings 20 rubbing against the inside surface of sleeve 11, without the need for coatings such a ceramic coatings.

Intake check valve plate 31 is preferably made out of K-monel, a very hard monel material available from Inco Alloys International, or another material having suitable mechanical properties, and the valve seat 32 of head 13 is preferably made out of 17-4 PH steel. The materials selection for both of these items results in providing an extraordinarily reliable sealing effect at cryogenic temperature, as well as high reliability.

Intake check valve plate 31 is held in the closed position by spring 34, which is disposed concentrically in the upper end of sleeve 11. Spring 34 is retained by spring retainer 35. As can be seen if FIG. 1, the upper end of piston 15 is recessed sufficiently to just clear spring 34 and spring retainer 35, while still having minimal clearance volume.

The discharge check valve 36 is preferably of the poppet valve type, preferably made out of 25% glass filled Kel-F which is seated by spring 37 against a valve seat 38 preferably made from 17-4 PH. This is a "soft-seat" sealing design to assure a gas tight seal across the discharge poppet valve 36 to positively retain the highest discharge pressure. This design of the discharge check valve results in a maximum flow at minimum pressure drop as compared to a conventional ball check design.

In tests of the cryogenic pump of the present invention, with the MSE seal 22, the TFE/bronze piston rings 19 and 17, the intake valve plate 5, and the discharge valve 36, the flow and discharge pressure of the pump at cryogenic working temperature was found to be greater by a factor of two as compared to a pump having a conventional design. It is believed the design of the MSE seal 22 helps to build more vacuum on the suction cycle so that the cold end can be fed more with fresh fluid. In addition, the MSE seal 22, acts together with the TFE/bronze piston rider rings and piston rings, the intake and discharge valve, to build higher discharge pressure with a very minimal amount of leakage across the convex outer wall 28 of the MSE seal 22 on the discharge cycle, even under conditions of low flow and low NPSP.

In the present invention, the MSE seal 22 takes the bulk of the discharge pressure, thus preventing damage to the TFE/bronze piston rings 20. The TFE/bronze piston rings 20 provide very good sealing with the sleeve but have less mechanical strength than the MSE seal 22. However, the TFE/bronze piston rings 20 also unload some of the discharge pressure exerted on the MSE seal 22. Therefore, the MSE seal 22 will wear less and last longer.

The bronze filed PTFE piston rider rings 19, and the bronze filed TFE piston rings 20, when used in conjunction with the MSE seal 22, automatically provide a means to lubricate the MSE seal 22 with worn bronze, as well as TFE particles. This minimizes galling and wear of the MSE seal 22 as well as the wall of sleeve 11.

In operation, pump 10 intakes LNG through a smooth, concentric venturi inlet 39, which is streamlined to help minimize the NPSP requirement. The LNG then opens intake check valve plate 31 against the force of spring 34. As can be seen in FIG. 1, the piston side of intake check valve plate 31 has a rounded, triangle shape in cross section, which also helps to minimize the NPSP requirement.

On the discharge stroke of piston 15, LNG is forced through discharge venturi 40, opening discharge poppet valve 36 against the force of spring 37, into head 13 and out tube 18.

The pump 10 in accordance with the present invention is capable of pumping LNG at a low flow rate of as little as 0.5 gpm while at high working pressures of up to 1000 psi when submerged in a LNG storage tank. Pump 10 has an unique net positive suction pressure (NPSP) requirement of subzero psig. Accordingly, pump 10 requires very little tank pressure to make the pump function properly, without excessive cavitation. This is very advantageous because the LNG is a saturated liquid and little suction pressure is available, particularly in transportation applications where tank size and location are limited.

Accordingly, the combination of design and material selection according to the present invention provide a pump for LNG service that is very rugged and reliable, able to operate at low flow under conditions of high discharge pressure, with low tank suction pressure, and long service life as mentioned above.

Although preferred and alternative embodiments of the present invention have been illustrated in the accompanying drawings and described in the foregoing DETAILED DESCRIPTION, it will be understood that the invention is not limited to the embodiments disclosed, but is capable of numerous rearrangements, modifications and substitutions of parts and elements without departing from the spirit of the invention.

What is claimed is:

1. A reciprocating pump for cryogenic fluids, said pump comprising a cylinder sleeve, head, intake valve, discharge valve, and reciprocating piston, said piston including a mechanical spring energized seal having a generally U-shaped jacket and a heliacal spring in the bite of the U for mechanical spring-energized sealing in both suction and compression, said U-shaped jacket defining a continuous circular seal with a U-shaped cross-section, including legs having disconnected ends and closed ends, said legs circumferentially parallel to said cylinder sleeve and said disconnected ends forming an opening into said U-shape, said opening directed away from said head so that pressure differential during suction expands said disconnected ends so that said seal is acts primarily to seal in suction.

2. The reciprocating pump defined in claim 1 wherein said jacket is made of Kel-F brand polychlorotrifluoroethylene material and said jacket is in a slight interference fit between the outer circumference of said piston and the inner wall of said cylinder sleeve.

3. The reciprocating pump defined in claim 1 wherein said legs of said U-shaped jacket comprise a convex outer wall in contact with said cylinder sleeve.

4. The reciprocating pump defined in claim 2 wherein said piston further include at least one bronze filled TFE piston ring circumferentially around said piston with said mechanical spring-energized seal positioned between said at least one bronze filled TFE piston ring and the top of the piston toward said head of said reciprocating pump.

5. The reciprocating pump defined in claim 1 wherein said sleeve is made from 440C stainless steel.

6. The reciprocating pump defined in claim 5 wherein said sleeve has a hardness of in the range of approximately Rockwell 50 to 55.

7. The reciprocating pump defined in claim 6 wherein said sleeve has a hardness of approximately Rockwell 55.

8. The reciprocating pump defined in claim 7 wherein said sleeve further has a surface finish of in the range of approximately number 4 to number 8.

9. The reciprocating pump defined in claim 8 wherein said sleeve has a surface finish of approximately number 8.

* * * * *